United States Patent [19]

Klaus et al.

[11] 4,380,313

[45] Apr. 19, 1983

[54] AIR-POWERED DRIVING TOOL, HAVING A PILOT PISTON AND CYLINDER

[75] Inventors: Arthur Klaus, Frankfurt am Main; Horst Tacke, Bad Vilbel, both of Fed. Rep. of Germany

[73] Assignee: Signode Corporation, Glenview, Ill.

[21] Appl. No.: 206,388

[22] Filed: Nov. 13, 1980

[30] Foreign Application Priority Data

Nov. 16, 1979 [DE] Fed. Rep. of Germany ..... 2946387

[51] Int. Cl.[3] ..... B25C 1/04

[52] U.S. Cl. ..... 227/130; 227/134

[58] Field of Search ..... 227/130, 134; 91/400, 91/403, 410

[56] References Cited

U.S. PATENT DOCUMENTS

| | | | |
|---|---|---|---|
| 3,498,517 | 3/1970 | Novak | 227/130 X |
| 3,563,438 | 2/1971 | Doyle et al. | 227/130 X |
| 3,599,854 | 8/1971 | Pearson | 227/130 X |
| 4,122,904 | 10/1978 | Haytayan | 227/130 X |
| 4,280,248 | 7/1981 | Hervbel | 227/130 X |

FOREIGN PATENT DOCUMENTS

| | | | |
|---|---|---|---|
| 203960 | 11/1958 | Austria | 91/403 |

*Primary Examiner*—Fred Silverberg

*Attorney, Agent, or Firm*—Dressler, Goldsmith, Shore, Sutker & Milnamow, Ltd.

[57] ABSTRACT

An air-powered driving tool for returning the working piston to its driving position by way of an auxiliary piston and valve arrangement. After the fastener is driven, the auxiliary piston is operated to engage the working piston to move it to its driving position after which the auxiliary piston is moved to an inoperative position. A valve is operated to direct high-pressure air to the auxiliary piston to move it to a working piston engaging position and then the air is released to allow it to return to its inoperative position. Thus, there is no force opposing the working piston when the driving tool is operated to drive a fastener into a workpiece.

7 Claims, 2 Drawing Figures

AIR-POWERED DRIVING TOOL, HAVING A PILOT PISTON AND CYLINDER

Figure 1:
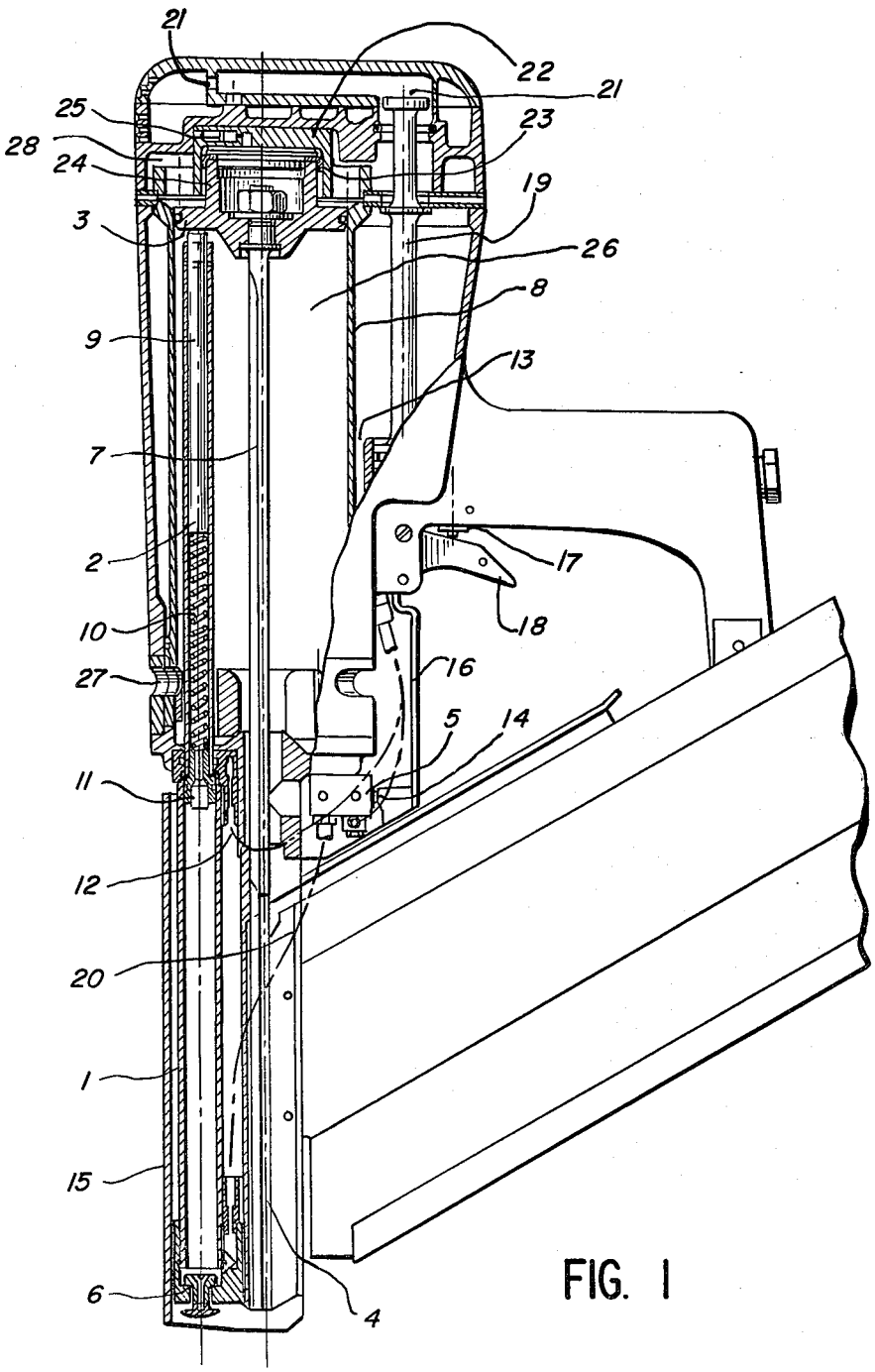

The present invention is with respect to an air-powered driving tool, more specially for long fixing parts (such as nails) with a cylinder having within it an axially moving working piston, a driver blade guided in a driving barrel and stiffly joined with the working piston, and a hand-worked control valve for joining, as desired, the working space of the cylinder with the atmosphere or with a compressed air input.

For air-powered driving tools, a great number of different systems have been put forward for moving the working piston back into its top dead center position. All these systems have, however, two important shortcomings. In fact, the systems are responsible for an important increase in the height or volume of the driving tool. Staple or nail driving tools for nails or staples up to 100 to 120 mm long may, it is true, be so designed that they may be lifted and used by one person. If, however, such old driving tools are scaled up for fixing parts, such as nails, of 130 to about 200 mm long, the tools may hardly be lifted by a single person and used in a normal way. A further shortcoming in this respect is that all systems so far designed make it necessary for the piston, in its working motion for driving a nail, or the like, home, to overcome a force-storing system, such as a gas or spring system, responsible for moving the piston back later. Such force-storing systems are responsible, however, for a decrease in the forces which are free for driving in the fixing part (or, to put it differently, the power piston is braked) and, because of this, make for greater piston diameters and greater sizes of control valves. These shortcomings naturally become even greater and, united together are responsible for an increase in the length and cross section of the fixing parts such as nails, or the like.

For some years now, the use of nails with a length of up to 200 mm was greatly increasing. However, the driving in of nails of this length, with a diameter of 6 mm, using a hand hammer makes necessary a great force on the part of the workman, so that there is presently a great need for driving tools of the right sort designed for long fixing parts. On the one hand, such driving tools for long fixing parts will have to have a very much greater driving rate than old driving tools, in which respect, however, the rate and the size of such tools are limited if they are to be lifted and used in the normal way by a workman by himself.

So the purpose of the invention is that of designing a driving tool of the sort noted which in comparison with normal driving tools of the same sort has a greater driving power or work rating.

This purpose is effected by the invention, which is characterized by a pilot cylinder, an axially moving piston within it, and a piston rod joined with the piston. The aforementioned piston is drivingly joined with the structure-unit made up of the working piston and driving blade. This is accomplished by a pilot valve with which the spaces of the pilot cylinder on the two sides of the piston may be joined in turn with the atmosphere and with the compressed air storing space, the cylinder having in the space under the working piston air let-off openings. The control valve and the pilot valve are so joined together by way of a connection unit that the working space of the cylinder may be joined with the compressed air storing space after that space of the pilot cylinder has been joined with the compressed air storing space, whose operation is responsible for motion of the piston into that end position in which its piston rod is drivingly unjoined from the structure-unit made up of the working piston and driving blade. The other space of the pilot cylinder is joined with the compressed air storing space after the working space of the cylinder has been joined with atmosphere, whereby the piston rod of the piston becomes drivingly joined with the structure-unit made up of the working piston and the driving blade for moving this structure-unit back into the starting position.

With a driving tool designed on these lines, there is the useful effect that its working piston does not, on its working motion, have to overcome any force-storing system, acting as a brake, used for moving the piston back again after the driving operation. The full unbraked work power of the driving tool may, for this reason, be used for driving in the fixed part, such as a nail. After the working motion of the tool, the control valve and the pilot valve are changed over so that the piston rod comes into driving connection with the structure-unit made up of the working piston and the driving blade, this unit then being moved back by the piston into the starting position without overcoming any opposite force or pressure. The pilot cylinder may, in this respect, be placed within the normal height of the driving tool, that is to say it does not make the driving tool any higher or longer.

Further developments of the invention of good effect will be seen in the dependent claims.

Two working samples of the invention, of which an account will now be given, will be seen in the figures.

Figure 2:
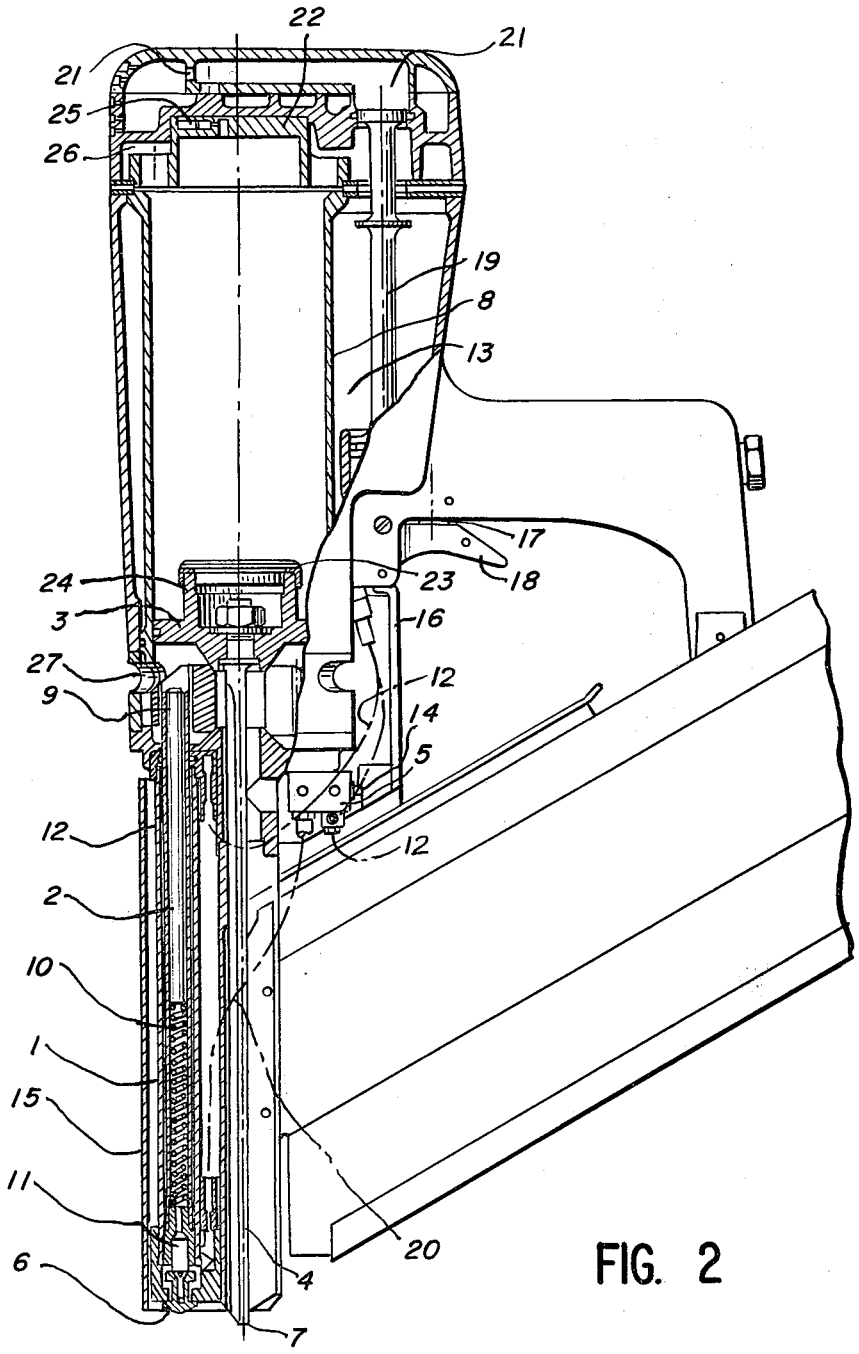

FIG. 1 is an upright cutaway view through an air-powered driving tool as the first working example of the invention; and FIG. 2 is a cutaway view like that of FIG. 1 in which respect the piston, placed in a pilot cylinder, is, however, to be seen in its lower and dead center position.

The air-powered driving tool of FIGS. 1 and 2 has a power or main cylinder 8, in which a power or working piston 3 is moved axially. The working piston 3 is fixedly joined with a driving blade 7 running in a driving barrel 4. A pilot cylinder 1 is so placed, parallel to the driving barrel 4, that the height of the tool is not made any greater, that is to say, than it would be if no such pilot cylinder 1 were present. In the pilot cylinder 1, a piston 11 is placed for axial motion. It is fixedly joined with a piston rod assembly 2, able to be moved up against the lower face of the working piston 3 to make it go back into its top dead center position after working motion, the piston rod assembly 2 then moving parallel to the driving blade 7 through the cylinder 8. The piston 11 is so controlled, by way of a pilot valve 5 and an outlet valve 6, that, before the start of the driving operation, it is moved back into its moved-in starting position so that the working piston 3 may undertake the driving operation without being braked by any opposite forces needed for a force-storing system designed for moving the piston back into its starting position.

The piston rod assembly 2 is made up of a pipe part, in which a feeler pin 9 (able to be moved up against the lower face of the working piston 3) is placed, pin 9 being acted upon by the force of a spring 10.

The outlet valve 6 is placed in the end plate of the pilot cylinder 1 and, when the driving tool is pushed up against the work, it is responsible, in addition to the pilot valve 5, for freeing an opening cross section of generally large size. Before the start of the driving operation, for this reason, the piston 11 is run, under the effect of the compressed air, joined at the head end by way of an air-way 12, with the compressed air storing space 13, into the lower dead center position.

On the other hand, the pilot valve 5 is so worked by way of a nosepiece 14 or cam of the workpiece sensing slide 15 that the air is let off from the space, placed under the piston 11 of the pilot cylinder 1 when the driving tool is run up against the work. On further axial motion of the sensing slide 15, a trigger valve 17, used with the main control valve 19, is put into a ready condition by way of a bridge-piece 16. After operation of the trigger 18, the main control valve 19 is opened and the compressed air, present in the storing space 13 of the driving tool, may go into the working space 26 of the cylinder 8 over the working piston 3. After lifting the driving tool clear of the work, that is to say, after taking the force from the sensing slide 15 and the trigger valve 17, the pilot valve 5 is changed over by the nosepiece 14 of the sensing slide 15 and the outlet valve 6 is shut, so that compressed air may go by way of air-ways 20 from the air-storing space 13 into the space, placed under the piston 11, of the pilot cylinder 1. Because of its cross section being greater at the lower end, the piston 11 is moved into the top position so that the working piston 3 is moved upwards as well, because, in view of the change-over, which has since been forced to take place, of the main control valve 19, the compressed air, present over the working piston 3, is let off by way of holes 21.

At the top end of the main cylinder 8 there is a vacuum piston keeper 22, into which a top headpiece 24, having a seal 23, of the working piston 3 is moved in the top dead center position of the working piston. This vacuum keeper has an automatic one-way valve 25, so that when the headpiece 24 of the working piston 8 is moved in, the air in the working space 26 may go into the space 28 placed over the working piston 3. Because this space 28 is joined with the atmosphere, when the main control valve 19 is open, the air is let off. At the start of the driving operation, the working piston 3, together with its headpiece 24, is pulled out of the vacuum chamber, because of the compressed air's acting on its upper face. Because at this time the one-way valve 25 is kept shut, there is the building up of vacuum in the vacuum space, which keeps acting on the working piston 3 and keeps it in position till, in the working space over the outer face of the working piston 3, the air pressure has become great enough, whereupon the headpiece 24 of the working piston 3 is fully cleared from the vacuum space 22. For this reason, the working piston 3 is quickly speeded up at the start of its motion.

The main cylinder 8 has in it air let-off openings 27 of large size under the lower dead center position of the working piston 3. The working piston 3 may, for this reason, undertake its working motion without acting against the force of force-storing systems, needed for moving the piston back again, because the air from the atmosphere, under the working piston, may be let off freely through the let-off openings 27. The working piston 3 does not, for this reason, have to overcome any greater forces (but for friction against the wall of the cylinder and the friction of the nail, or the like, being moved in position) than is the case with completely free motion.

What is claimed is:

1. An air-powered driving tool, specially for long fixing parts, such as fasteners, comprising a housing including a driving barrel and defining a chamber containing air under pressure, a first cylinder in said housing, a working piston disposed within said first cylinder, a driver blade joined to said working piston and guided in said driving barrel, first valve means for controlling the flow of air under pressure to said cylinder to move said working piston from a driving to a driven position, valve regulated means for returning the working piston from the driven position to the driving position, said valve regulated means comprising a pilot cylinder, a piston operated assembly including a pilot piston disposed in said pilot cylinder and constructed and arranged to control movement of movable means to contact said working piston to return it to the driving position and second valve means for regulating the flow of high pressure air to and from said pilot cylinder, whereby the movable means will be out of contact with said driving piston during its driving action and will be moved into contact with the driving piston after it has been driven to return it to the driving position.

2. An air-powered driving tool as set forth in claim 1 in which the movable means comprises a rod for engaging said working piston, which rod is in alignment with and connected to said pilot piston in the pilot cylinder.

3. A driving tool as set forth in claim 2 including a workpiece sensing assembly means slidably disposed relative to said housing and means responsive to the contact of the tool with the workpiece and the movement of said sensing assembly to vent said pilot cylinder to effect movement of said pilot piston away from said driving piston and to permit operation of said first valve means to admit air to said first cylinder to drive said working piston.

4. A driving tool as set forth in claims 2 or 3 characterized in that the pilot cylinder is disposed adjacent to said driving barrel and said pilot piston is positioned to engage the lower side of the working piston when said second valve means is positioned to admit high pressure air to said pilot cylinder to move the pilot piston and said rod into engagement with the lower side of the working piston after it has been driven.

5. A driving tool as set forth in claim 3 in which the means responsive to the contact of the tool with the workpiece includes a valve engaged by the workpiece to vent the pilot cylinder to facilitate disengagement of the rod from the working piston prior to its being driven from the driving to the driven position.

6. A fastener driving tool comprising a housing having a barrel section, a working cylinder in said housing, a working piston disposed in said cylinder, main valve means controlling the operation of said working piston, a driver blade slidably disposed in said barrel section and secured to said working piston for driving a fastener into a workpiece, a pilot cylinder disposed in said barrel section, a pilot piston in said pilot cylinder, said pilot piston adapted to engage the working piston to return it to the driving position, and valve means controlling the flow of high-pressure air to and from said pilot piston to control the movement of said pilot piston to return the working piston to its driving position and permit return of the pilot piston to its inactive position.

7. A driving tool as set forth in claim 6 including a workpiece sensing means which controls the operation of said valve means to control the operation of said pilot piston.

* * * * *